United States Patent [19]

Thompson

[11] Patent Number: 4,872,236

[45] Date of Patent: Oct. 10, 1989

[54] CORNER PAINTING ATTACHMENT FOR PAINT ROLLERS

[76] Inventor: Marshall A. Thompson, 1253 N. Modesto, Camarillo, Calif. 93010

[21] Appl. No.: 210,246

[22] Filed: Jun. 24, 1988

[51] Int. Cl.[4] ..... B05C 17/00

[52] U.S. Cl. ..... 15/118; 15/230.11; 15/248 A; 15/257 R

[58] Field of Search ..... 15/118, 230.11, 248 A, 15/257 R

[56] References Cited

U.S. PATENT DOCUMENTS

| | | | |
|---|---|---|---|
| 2,929,089 | 3/1960 | Nall | 15/230.11 |
| 2,959,800 | 11/1960 | Bishoff | 15/230.11 X |
| 3,205,526 | 9/1965 | Archibald | 15/230.11 |
| 3,369,269 | 2/1968 | Deck et al. | 15/230.11 |
| 3,662,422 | 5/1972 | Christensen et al. | 15/230.11 |
| 4,402,102 | 9/1983 | Al-samman | 15/230.12 X |
| 4,528,712 | 7/1985 | Leibow | 15/230.11 X |

FOREIGN PATENT DOCUMENTS

| | | | |
|---|---|---|---|
| 728940 | 5/1980 | U.S.S.R. | 15/230.11 |

*Primary Examiner*—Chris K. Moore

[57] ABSTRACT

A corner painting attachment for paint rollers comprising a generally circular device formed of paint retaining material, such as open-cell foam, configured to fit on the handle of a paint roller adjacent the paint applying roller and having upwardly and inwardly tapering upper surfaces meeting in a line parallel to the handle of the paint roller.

7 Claims, 1 Drawing Sheet

CORNER PAINTING ATTACHMENT FOR PAINT ROLLERS

BACKGROUND

1. Field of the Invention

This invention relates to painting equipment and is particularly directed to means for attachment to paint rollers and the like to facilitate painting in corners, along edges and other difficult locations.

2. Prior Art

The introduction of the paint roller has greatly increased the speed and ease with which large areas, such as walls, ceilings and the like can be painted. However, when attempts are made to use paint rollers for more delicate work, such as painting corners or edges adjacent doors, windows and the like, paint rollers are often inadequate and sloppy. Numerous attempts have been made heretofore to overcome these problems. However, none of the prior art corner painting devices have been entirely satisfactory.

A search in the U.S. Patent Office has revealed the following patents:

| U.S. Pat. No. | INVENTOR | ISSUE DATE |
|---|---|---|
| 3,623,180 | R. L. Anderson | Nov. 30, 1971 |
| 3,662,422 | R. S. Christensen et al | May 16, 1972 |
| 3,906,581 | F. Marino et al | Sep. 23, 1975 |
| 4,402,102 | Z. A. Al-samman | Sep. 6, 1983 |

The patents to Christensen and Al-samman each disclose corner painting attachments for paint rollers. However, each of these devices is more complicated and expensive to produce than that of the present invention. The patent to Marino suggests the use of bevelled ends for his roller. However, they would not appear to be useful for painting corners. Thus, none of the prior art corner painting devices seems to be entirely satisfactory.

BRIEF SUMMARY AND OBJECTS OF INVENTION

Although paint rollers are of great value in painting large areas, such as walls, ceilings and the like, they have not been found satisfactory for more delicate work, such as painting corners or areas close to the frames of doors or windows or close to floor or ceiling mouldings. The reason for this is that the rollers are usually provided with a paint holding layer formed on a fiberous material which is excellant for retaining substantial quantities of paint for application, but which tends to present a fuzzy or irregular edge pattern which is not conducive to painting straight lines of narrow width. Furthermore, because of the dimensions of most paint rollers, it is difficult or impossible to apply paint in proximity to raised articles which are not to be painted. This presents problems in painting close to the frames of doors or windows, in painting close to floor or ceiling mouldings and in painting corners.

These disadvantages of the prior art are overcome with the present invention and a corner painting attachment is provided for use on paint rollers which enables the user to accurately paint straight lines in restricted areas and to paint close to raised articles which are not to be painted without fear of applying paint in unwanted areas.

The advantages of the present invention are preferably attained by providing a corner painting attachment for paint rollers comprising a generally circular device formed of paint retaining material, such as open-cell foam, configured to fit on the handle of a paint roller, adjacent the paint applying roller and having upwardly and inwardly tapering upper surfaces meeting in a line parallel to the handle of the paint roller. With this attachment mounted on the paint roller, the user may employ the roller for painting large areas in a conventional manner. However, whe it is necessary or desirable to paint an area close to a raised article which is not to be painted, the user can immerse the corner painting attachment of the present invention in the paint and can, then, apply paint immediately adjacent the raised article without fear of applying unwanted paint.

Accordingly, it is an object of the present invention to provide improved means for attachment to paint rollers to facilitate painting in corners and in proximity to raised articles which are not to be painted.

Another object of the present invention is to provide a corner painting attachment for paint rollers which is simple and economical to produce and is easy to use.

An additional object of the present invention is to provide a corner painting attachment for paint rollers which can be purchased separately and can be installed quickly and easily on a pre-existing paint roller.

A specific object of the present invention is to provide a corner painting attachment for paint rollers comprising a generally circular device formed of paint retaining material, such as open-cell foam, configured to fit on the handle of a paint roller adjacent the paint applying roller and having upwardly and inwardly tapering upper surfaces meeting in a line parallel to the handle of the paint roller.

These and other objects and features of the present invention will be apparent from the following detailed description, taken with reference to the figures of the accompanying drawing.

DETAILED DESCRIPTION OF THE INVENTION

Figure 1:
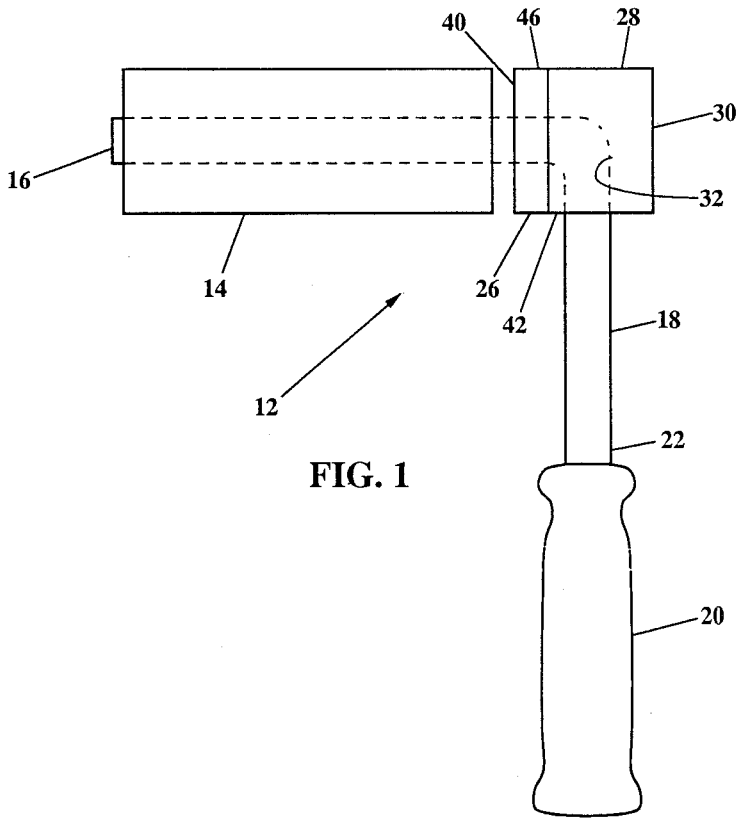
FIG. 1 is a diagrammatic representation of a paint roller having the corner painting attachment of the present invention installed thereon.

In that form of the present invention chosen for purposes of illustration, FIG. 1 shows a paint roller, indicated generally at 12, having a roller portion 14 rotateably mounted on one end 16 of a generally L-shaped shaft 18 with a handle portion 20 mounted on the other end 22 of the shaft 18. The handle 20 and shaft 18 may be formed of any desired material, while the roller portion 14 is formed of, or at least covered with, a porous material for retaining a quantity of paint and transfering the paint to a surface to which the roller is applied. To facilitate painting in confined areas, such as corners or areas adjacent raised articles which are not to be painted, such as the frames of doors or windows, the present invention calls for a corner painting attachment 24 to be mounted on the shaft 18 adjacent the inner end of the roller 14.

Figure 2:
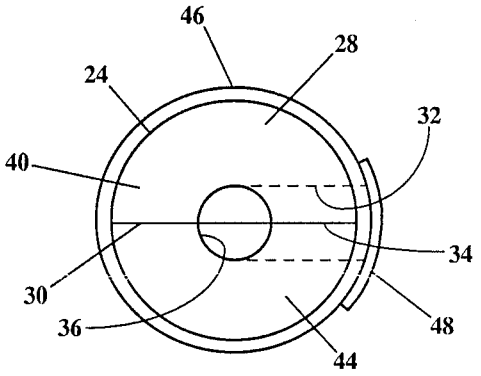
FIG. 2 is a side view of the corner painting attachment of FIG. 1.
Figure 3:
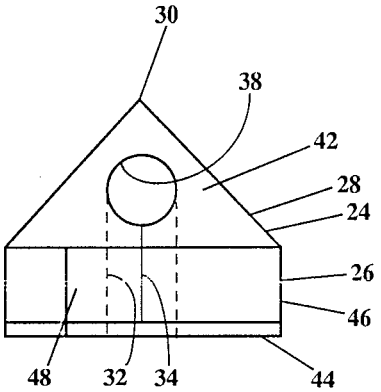
FIG. 3 is an end view of the corner painting attachment of FIG. 2.

As best seen in FIGS. 2 and 3, the corner painting attachment 24 is preferably formed of a porous material, such as an opencell foam, and comprises a generally cylindrical base portion 26 and a taper upper portion 28 having upwardly and inwardly sloping sides which meet in a common line, as seen at 30. To permit mounting the corner painting attachment 24 on the shaft 18 of the paint roller 12, the corner painting attachment 24 is preferably formed with a generally L-shaped internal channel, as indicated at 32, which conforms generally to the shape of the shaft 18 and communicates with openings 36 and 38 formed, respectively, in the bottom 40 (end of said portion) and side 42 of the upper portion the corner painting attachment 24. Also, a slit 34 communicates the channel 32 with the bottom 40 and side 42 of the corner painting attachment 24 to permit insertion of the shaft 18 into the channel 32. If desired, a sheet 44 of a suitable stiffening material to facilitate retention of the corner painting attachment 24 in position on the shaft 18. Alternatively, or in addition, a band 46 of adhesive material may be provided about the base portion 26 of the corner painting attachment 24 having an overlapping portion 48 extending past the slit 34 to releaseably fasten the slit 34 closed, after the shaft 18 has been inserted. to retain the corner painting attachment 24 mounted on the shaft 18.

In use, the corner painting attachment 24 is mounted on the paint roller 12 by inserting the shaft 18 into the channel 32 through the slit 34 and, if provided, is secured by pressing the overlapping portion 48 of the adhesive band 46 to releaseably close the slit 34. Thereafter, the user may paint large areas using the paint roller 12 in a conventional manner. However, when it is necessary or desirable to paint in a confined area, such as a corner or adjacent a raised article which is not to be painted, such as the frame of a door or window, the user dips the corner painting attachment 24 in the paint and, then, can paint the restricted area neatly and easily without fear of getting paint in unwanted places.

Obviously, numerous variations and modifications can be made without departing from the spirit of the present invention. Therefore, it should be clearly understood that the forms of the present invention described above and shown in the accompanying drawings is illustrative only and is not intended to limit the scope of the present invention.

I claim:

1. A corner painting attachment for use with a paint roller having a generally cylindrical roller and a generally L-shaped handle with said roller rotatably mounted on one leg of said handle and the other leg of said handle extending substantially perpendicular to the axis of said roller, said attachment comprising:

a base portion formed to releasably mount on the handle of said paint roller adjacent the bend of said handle and formed with a tapered upper portion having sides inclining toward each other and joining in a line extending parallel to said other leg of said handle.

2. The corner painting attachment of claim 1 wherein: said attachment is formed of porous material.

3. The corner painting attachment of claim 1 further comprising:

a generally L-shaped channel formed in said attachment communicating with the end of said base portion and a side of said upper portion facing said other leg to permit mounting said attachment on the shaft of a paint roller.

4. The corner painting attachment of claim 3 further comprising:

a slit communicating said channel with the end of said bore portion and with said side of said upper portion to permit insertion of the paint roller shaft into said channel.

5. The corner painting attachment of claim 1 further comprising:

a sheet of stiffening material secured to the end of the base portion of said corner painting attachment.

6. The corner painting attachment of claim 1 further comprising:

a band of adhesive material extending about said base portion and having an overlapping portion for securing said corner painting attachment mounted on the shaft of said roller.

7. The corner painting attachment of claim 1 further comprising:

said corner painting attachment being formed of opencell foam material.

* * * * *